United States Patent [19]

Warren et al.

[11] Patent Number: 4,572,736

[45] Date of Patent: Feb. 25, 1986

[54] PROCESS FOR PRODUCING MAGNESIUM

[75] Inventors: Geoffrey F. Warren, Leidschendam; Andrew M. Cameron, Arnhem, both of Netherlands

[73] Assignee: Shell Internationale Research Maatschappij B.V., Netherlands

[21] Appl. No.: 675,600

[22] Filed: Nov. 28, 1984

[30] Foreign Application Priority Data

Dec. 21, 1983 [GB] United Kingdom ..... 8334022

[51] Int. Cl.[4] ..... C22B 4/02; C22B 26/22

[52] U.S. Cl. ..... 75/10 R; 75/67 R

[58] Field of Search ..... 75/67 R, 10 R

[56] References Cited

U.S. PATENT DOCUMENTS 3,579,326 5/1971 Avery ..... 75/67 R 4,066,445 1/1978 Johnston et al. ..... 75/67 R 4,190,434 2/1980 Bonfils et al. ..... 75/67 R 4,478,637 10/1984 Christini et al. ..... 75/67 R

*Primary Examiner*—Melvyn J. Andrews

*Attorney, Agent, or Firm*—Jones, Tullar & Cooper

[57] ABSTRACT

Magnesium is produced by carbothermic conversion of magnesia in a process which comprises effecting the reaction in the presence of a liquid slag comprising oxides or mixed oxides and carbides of magnesium, calcium and aluminium in relative weight proportions, calculated as atomic metal:metal ratios, which by continued introduction of appropriate feedstock into the reactor are being kept within the following ranges (i) Mg:Ca from 0.28:1 to 1.34:1

(ii) Al:Mg from 0.79:1 to 3.16:1

(iii) Ca:Al from 0.48:1 to 1.50:1 under the proviso that the total amount gramatom aluminium is less than 51% of the total amount gramatoms aluminium, calcium and magnesium contained in the slag.

15 Claims, 2 Drawing Figures

PROCESS FOR PRODUCING MAGNESIUM

This invention is concerned with a process for producing magnesium by stoichiometric conversion of magnesia with carbon at a temperature of at least 2000° K. and at atmospheric pressure. In this description the term "stoichiometric conversion" is used to define all conversions effected in accordance with the overall reaction $MgO+C \rightarrow Mg+CO$.

About 100 years ago Emil von Puettner proposed to produce metallic magnesium by carbothermic conversion of magnesia at atmospheric pressure. This concept was further developed by F. Hansgirg about 50 years later and commercial plants were constructed in the United States of America, England and in Korea (The Iron Age, Nov. 18, 1943, pages 56–63). In the Hansgirg process pellets or briquettes comprising magnesia and carbon are introduced into an arc furnace reactor which is heated to a temperature above 2250°K. Magnesium vapour so produced and carbon monoxide gas are transferred from the reactor to a quenching zone in order to avoid the occurrence of the back reaction $Mg+CO \rightarrow MgO+C$. To achieve adequate quenching, the gaseous reaction products may be contacted with a spray of molten metal or hydrocarbon oils. Whilst Hansgirg preferred to spray with hydrocarbon oils, proposals of later date include the spraying with molten magnesium, sodium, aluminium or magnesium-aluminium alloys. Further purification of the metallic condensates may then be effected by distillation.

Since magnesia feedstocks normally comprise impurities, such as calcium oxide and alumina and to a lesser extent silica and iron oxides, one of the problems in the carbothermic conversion of magnesia is to decide at what stage one should achieve the separation of the impurities from the envisaged magnesium metal. In the Hansgirg process, this separation is effected at a stage subsequent to the withdrawal of the gaseous reaction products from the reactor (l.c. page 59). This was achieved by supplying an additional amount of carbon to the reactor which amount was so calculated as to convert all oxidic impurities into volatile carbides "which flew out of the furnace space by the force of the reaction". Consequently, no slag was left in the reactor. The principle of subsequent separation, which is essential to the Hansgirg process, significantly complicates the further purification of the condensed metallic magnesium and the present invention aims to achieve a simplified and improved process in which such problems are avoided.

The invention provides a process for producing magnesium by stoichiometric conversion of magnesia with carbon at a temperature of from 2000° K. to 2300° K. and atmospheric pressure which comprises effecting the reaction in a reactor in the presence of a liquid slag comprising oxides or mixed oxides and carbides of magnesium, calcium and aluminium in relative weight proportions, calculated as atomic metal:metal ratios, which by continued introduction of appropriate feedstock into the reactor are being kept within the following ranges (i) Mg:Ca from 0.28:1 to 1.34:1
(ii) Al:Mg from 0.79:1 to 3.16:1
(iii) Ca:Al from 0.48:1 to 1.50:1, under the proviso that the amount gramatom aluminium is less than 51% of the total amount gramatoms aluminium, calcium and magnesium contained in the slag.

Figure 1:
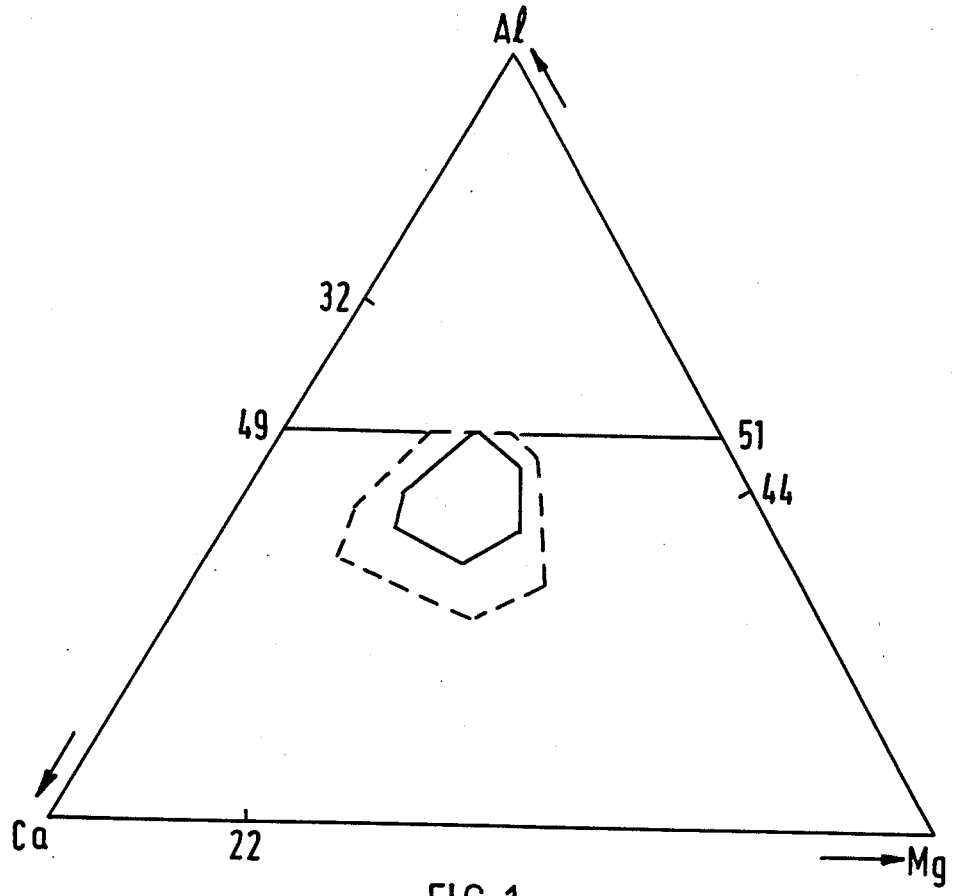
FIG. 1 is a three component diagram illustrating the percent composition of the three involved metals.

The relevant atomic metal:metal ratios are illustrated in FIG. 1, which is based on a conventional way of representing three-component systems in a triangle of which the coordinates of the vertices are 100 Mg, 0 Al, 0 Ca; 0 Mg, 100 Al, 0 Ca and 0 Mg, 0 Al, 100 CA. The aforesaid ratios can also be written as (i) Mg:Ca from 22/78 to 57/43
(ii) Al:Mg from 44/56 to 76/24
(iii) Ca:Al from 32/68 to 60/40 and the latter way of representing the ratios leads to the presentation in FIG. 1, from which it appears that the ratios to be used in the process of this invention are selected within the fairly small area enclosed by the dotted lines. In this FIG. 1 the horizontal line 49–51 marks the upper limit of all compositions which contain less than 51% at. Al, based on the total amount at. Al, Ca and Mg. Hence, this invention excludes the use of slag compositions lying in the area above that line. FIG. 1 also refers to another area, i.e. the smaller area enclosed by the drawn lines, this area is defined by the atomic metal:metal ratios (iv) Mg:Ca from 31/69 to 53/47 or (iv) from 0.46:1 to 1.14:1
(v) Al:Mg from 54/46 to 71/29 or (v) from 1.19:1 to 2.43:1
(vi) Ca:Al from 35/65 to 53/47 or (vi) from 0.56:1 to 1.11:1

The latter ratios mark the preferred mode of oparating the process of this invention.

For obtaining the benefits of the process of this invention it is essential to observe the critical atomic metal:-metal ratios set out above. The importance of this is elucidated by the following information:

In the slag system employed in this invention the main reactions are thought to be $$MgO+C \rightleftharpoons Mg+CO \quad (1)$$

$$CaO+3C \rightleftharpoons CaC_2+CO \quad (2)$$

$$2Al_2O_3+9C \rightleftharpoons Al_4C_3+6CO \quad (3)$$

In the present context it is considered irrelevant whether the carbothermic conversion of magnesia (reaction 1) actually proceeds as indicated or via the intermediate formation of $MgC_2$, $CaC_2$ or $Al_4C_3$. All reactions are equilibria and because of the evaporation of metallic magnesium and the withdrawal of gaseous CO and Mg vapour from the reactor it will be clear that equilibrium 1 is shifted to the right. On the other hand, CO is continuously evolved in the slag by reaction 1, and, as reaction 1 proceeds stoichiometrically, the concentration of carbon in the slag will be kept at a fairly low value. Both the CO concentration and the relatively low carbon concentration in the slag ensure that equilibria 2 and 3 are shifted to the left. Both CaO and $Al_2O_3$ will therefore remain trapped in the slag at least to a significant extent. Of the three reactions, reaction 1 thermodynamically favoured in respect of reactions 2 and 3.

The reaction products withdrawn from the reactor will therefore substantially consist of magnesium vapour and carbon monoxide and the concentration of volatile calcium- and aluminium carbide in the gaseous reaction product will be very small, if detectable at all. Since both calcium oxide and aluminium oxide are normally introduced into the reactor at least partly in the form of impurities of the magnesia feedstock it will be clear that the process of this invention is operated basically in accordance with the principle of effecting the necessary separation of impurities and metallic magnesium in the reactor, i.e. during the carbothermic magnesia conversion per se, and not in a subsequent operation. The method of this invention is therefore clearly distinguished from the Hansgirg process.

Reactions 2 and 3 are competing with reaction 1 but, in addition, they are also mutually competing. In an ideal situation they should be controlled to ensure that in reaction 2 the percentage conversion of oxide into carbide is as closely similar to that in reaction 3 as is thermodynamically possible. Since such closely similar conversion percentages are difficult to achieve, a marginal difference in conversion has to be tolerated for practical reasons. Some margin in the calcium-:aluminium ratio in the slag system is therefore allowed for and this margin is set by the limiting ratios of 0.48:1 and 1.50:1, preferably 0.56:1 to 1.11:1. Beyond these critical limits one of reactions 2 or 3 is strongly favoured over the other and the slag is no longer stable but its composition shifts towards higher concentrations of calcium carbides when one oparates at ratios selected in the lower left corner of the triangle in FIG. 1 and towards higher aluminium carbide concentrations when one operates at ratios closer to the top corner of the triangle. When operating within the selected area the stability of the slag is acceptable for all practical purposes and should there nevertheless be a tendency to production of too much of either calcium carbide or aluminium carbide, the return into the desired correct area can easily be achieved by increasing the calcium oxide or aluminium oxide input into the reactor. This can be done by using special magnesia feedstock containing more calcium- or aluminium oxide then usual or by leaving the composition of the feedstock unchanged and introducing additional amounts of calcium- or aluminium oxide into the reactor separate to usual magnesia feedstock.

Control of the composition of the slag is easily achieved by withdrawing slag samples and analysing to determine the respective contents of magnesium, aluminium and calcium, considered as metal.

As set out hereinabove, reaction 1 is thermodynamically favoured in respect of both reactions 2 and 3. This favouring is more pronounced if one moves the relative proportions, which must be selected within the area in FIG. 1, towards the right hand corner of the triangle and less pronounced if one moves away from the right hand corner towards the Ca-Al side. Moving over the dotted line away from the Mg-corner into the area which is too far to the left creates inadequate favouring. So, in a slag having such an incorrect composition, the lowered magnesia content corresponds with an increased calcium- and aluminium oxide content. This in its turn increases the calcium carbide and aluminium carbide content of the slag. Volatilisation of calcium- and aluminium carbide will increase, thus resulting in an unacceptably high level of contamination of the gaseous reaction products withdrawn from the reactor. For this reason the lower limit of the magnesium:calcium ratio is set at 0.28:1 and the upper limit of the aluminium to magnesium ratio is set at 3.16:1 for the same reason. The remaining limiting Mg:Ca and Al:Mg ratios (upper, respectively lower limits) are governed by the maximum levels at which the magnesium compounds are soluble in the slag system. Above these levels one would no longer have a homogeneous liquid system but instead thereof, a system comprising a dispersion of solid magnesia or magnesium carbide in slag. This phenomenon would once again create instability of the slag system; which is to be avoided when operating the process of this invention.

In a slag sample that has been withdrawn from the reactor, it is difficult to determine the exact amounts of calcium- and aluminium carbide, since distinguishing the amount of chemically bound carbon from the amount of physically abosorbed (dissolved or dispersed) carbon involves complicated analysing methods. Moreover, it should be stressed that in the operation of the process of this invention it is in fact irrelevant to know to what extent the carbide forming reactions 2 and 3 actually proceed in the slag system. The very same applies to possibly other proceeding reactions involving conversion of calcium- and aluminium-oxide into -carbides. Most likely, carbide formation remains below the levels of 10 or 12% conversion anyway because at higher percentages one would notice a significant contamination of the gaseous products withdrawn from the reactor with carbides, which is not the case. The important aspect of this invention is that with slag compositions selected within the appropriate limiting atomic metal:metal ratios one achieves stable operation of the process of this invention and a stable slag system, irrespective the exact level of carbide formation in the slag. This level will automatically be kept relatively low by the correct operation of the process and the carbide content in this slag does therefore not have to be known in precise details.

Presumably, some carbide formation is unavoidable and since carbide formation would obviously have its impact on the definition of the composition of the slag if this were defined in terms of oxide weight to weight ratios, the correct ratios to be observed in the process of this invention are defined as atomic metal:metal ratios. The latter are independent of carbide formation. The amount of e.g. calcium compounds in the slag, calculated as gramatom calcium metal, remains the same, irrespective the level of calcium carbide formation.

Clearly, similar complications relative to carbide formation do not exist in the description of the starting materials that will usually be employed in the process of this invention, i.e. slag and magnesia feedstock. Therefore both materials will be described hereinafter in oxide:oxide weight:weight ratios.

In a preferred mode of operation the process is started by the introduction into the reactor of a mixture of MgO, CaO and $Al_2O_3$ in weight:weight ratios selected in the following ranges (a) MgO:CaO from 0.20:1 to 0.96:1, equalling 16/84 to 49/51

(b) $Al_2O_3$:MgO from 1.0:1 to 4.0:1, equalling 50/50 to 80/20

Figure 2:
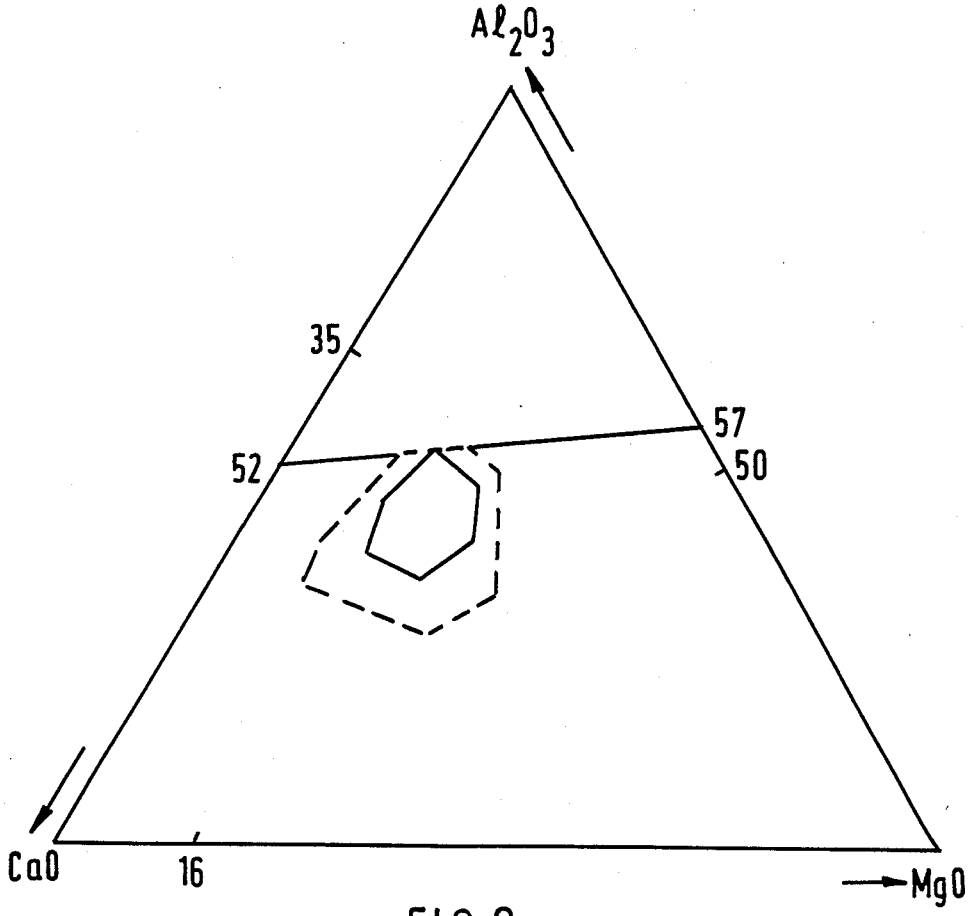
FIG. 2 is a three component diagram illustrating the percent composition of the three involved metal oxides.

(c) CaO:$Al_2O_3$ from 0.54:1 to 1.67:1, equalling 35/65 to 63/37 excluding those relative proportions resulting in slag compositions lying in the area above the line marked 52–57 in FIG. 2.

This definition comprises mixtures selected within the range marked by the dotted lines in FIG. 2. The best ratios are selected from the ranges (d) MgO:CaO from 0.33:1 to 0.82:1, equalling 25/75 to 45/55

(e) $Al_2O_3$:CaO from 1.5:1 to 3.1:1, equalling 60/40 to 76/24

(f) CaO:$Al_2O_3$ from 0.61:1 to 1.22:1, equalling 38/62 to 55/45

This preferred definition comprises specific selections within the smaller area marked by the drawn lines in FIG. 2.

Subsequent to the introduction of such a selected mixture, the contents of the reactor are heated to melt the slag and a pelletized or briquetted stoichiometric mixture of carbon and magnesia feedstock is gradually introduced into the reactor when the temperature of the molten slag starts to approach the reaction temperature of at least 2000°K and preferably at most 2250°K. Common magnesia feedstock will normally be chosen to comprise calcium oxide and alumina impurity levels of up to 1.5% w each, but higher levels, of for example 3 or 5% w can also be employed. Levels below 0.8% w each are preferred, since this lengthens the period of time over which the reactor can be operated before the slag should be tapped at least partly. When the reaction proceeds, the MgO level in the slag tends to decrease in line with the production of magnesium vapour, which together with CO is withdrawn from the reactor. This decrease is compensated for by the continued introduction of magnesia feedstock which should be effected at a rate to keep the content of magnesium compounds (calculated as magnesium metal) within the specified limits. As constituants of impure magnesia feedstock, calcium- and aluminium oxide impurities are also introduced into the reactor and whenever the calcium to aluminium metal ratio would tend to move over the required limiting values, the appropriate oxide is additionally introduced into the reactor in order to bring the relevant metal to metal ratio back within the specified range.

As set out above, the calcium and aluminium impurities remain trapped in the slag which in batch operations therefore gradually grows in volume. The volumetric increase of the liquid reactor contents may be continued until the moment at which tapping the slag from the reactor becomes required. Obviously, all slag may be tapped, after which the complete reaction cycle may be repeated or some slag may be left in the reactor and the process can be repeated whilst omitting the first introduction of mixture described hereinabove as slag-forming starting material.

Examples of impurity levels in magnesia feedstock which ensure a stable operation and a stable slag system for a markedly prolonged period of time are 1.7% w CaO and 0.02% w $Al_2O_3$; 1.0% w CaO and 1.01% w $Al_2O_3$; and 3.9% w CaO and 4.9% w $Al_2O_3$. Examples of attractive compositions to be employed as first slag-forming starting material are mixtures comprising 22.1% w MgO, 33.7% w CaO and 44.2% w $Al_2O_3$, (these weight percentages being based on the total weight of these three components) or comprising 19.4% w MgO, 34,6% w CaO and 45,8% w $Al_2O_3$; or 17.2% w MgO, 36.5% w CaO and 46.3% w $Al_2O_3$.

Other impurities that can easily be tolerated in the slag system are iron oxides and silica. Iron oxide will be reduced to iron so that together with the volumetric increase of slag in the reactor one obtains a gradually growing volume of iron as a second liquid phase in the reactor. Slag and iron can be successively tapped from the reactor and the iron so separated can be used for other purposes. Silica will be partly reduced to silicon carbide more or less in line with the formation of carbides from calcium- and aluminium oxide. The presence of silica or silicon carbide in the slag does not disturb the stability of the slag system provided the level of silicium compounds in the slag is kept at a fairly low level, i.e. below a metal:metal ratio, calculated on either calcium or aluminium, whichever is the metal present in the lowest amount, of 0.20:1, preferably less than 0.10:1.

Next to batch operation it is also possible to carry out the process of this invention as a continuous process; this involves continuous tapping of slag, or of slag and molten iron, via one or more tapping openings provided at different levels above the bottom of the reactor.

The reactor in which the process of this invention is carried out can be of any suitable design, e.g. a reactor provided with external heating means or with heating in the wall. Much preferred is the application of direct heating means, as in an arc furnace in which heating is supplied by electrodes which are immersed in the liquid slag system, or as in a reactor provided with plasma heating. It is another important advantage of the use of an arc furnace that the violent heating by passing the strong electric current through the slag ensures a turbulent movement of the entire slag volume which in its turn effects a very efficient distribution of heat over the entire liquid slag volume.

The reactor can also be provided with external cooling means, e.g. a waterjacket, to control the required temperature of the contents of the reactor. Refractory materials are employed for the inner lining of the reactor and one of the surprising features of this invention is that one can apply a lining of refractory magnesia bricks. Since the slag remains substantially saturated or relatively close to saturation in magnesium oxide by the continued further supply of magnesia feedstock during the carbothermic conversion reaction, the magnesia of the lining bricks will not dissolve in the slag.

The gaseous reaction products withdrawn from the reactor may be transferred to a quenching zone. Any suitable quenching means may be employed but it is preferred to apply the spraying or atomizing of molten magnesium, sodium, aluminium or magnesium- aluminium alloy. In the latter two cases the final product of the process may be a magnesium-aluminium alloy with a predetermined magnesium content or the alloy can be separated by distillation into pure magnesium and aluminium.

The molten metal used for spraying may continuously be recycled through a loop system, with withdrawal of a product stream at any suitable position. A purification system for removing solid particles, e.g. oxidic and carbidic impurities, may be included in the loop system, e.g. a flotation furnace provided with a spinning nozzle, as disclosed in U.S. Pat. No. 3,743,263. Since the amount of solid impurities in the gaseous reaction products withdrawn from the carbothermic conversion reactor is very small if not at all negligible, it follows that the flotation furnance can be operated for many hours before the amount of impurities trapped in that furnace has increased so much that replenishing of the purification reactants becomes necessary.

EXAMPLE 1

A magnesia feedstock comprising 92.1% w MgO, 1.26% w CaO, 1.26% w $Fe_2O_3$, 1.26% w $Al_2O_3$, 3.15% w $SiO_2$, and 0.89% w trace impurities was briquetted with a stoichiometric amount, relative to MgO, of needle coke carbon. A slag composition was prepared by mixing 22.0% w MgO, 35.2% w CaO, 0.3% w $Fe_2O_3$, 41.0% w $Al_2O_3$ and 1.5% w $SiO_2$. 49.7 kg of this slag mixture were introduced into a 50 kW single phase arc furnace reactor, provided with magnesia lining and having an internal volume of 58.0 1. The slag was melted and heated to a temperature of 2220°K.

During a period of 6 hours a total quantity of 40.8 kg feedstock briquettes were introduced into the reactor at a constant addition rate. The gaseous product withdrawn from the reactor comprising magnesium vapour, CO and impurities was combusted completely and the amounts of calcium, silicium and aluminium impurities were determined from time to time by chemical analysis and calculated as a percentage on oxidic product. The product comprised at least 98.3% w MgO during the complete length of the run. Samples were withdrawn from liquid slag in the reactor at regular intervals, these samples were analysed to determine the relative amounts of metal compounds, calculated as oxides.

The analytical data are represented in Tables I and II. By comparing the calcium, aluminium and silicium impurity levels from Table II with the corresponding impurity levels in the magnesia feedstock it can be concluded that the percentage of calcium, aluminium and silicium impurities that remain trapped in the slag is on average about 60%, respectively 83% and 96%. In addition, Table I shows that the composition of the slag shows only a very small variation, hence, may be considered stable for practical purposes. There is no tendency towards run-away reactions leading to preferential conversion of either CaO, $Al_2O_3$ or $SiO_2$.

TABLE I

| | Slag composition, % w | | | | |
|---|---|---|---|---|---|
| Time, h | CaO | $SiO_2$ | $Al_2O_3$ | MgO | FeO |
| 0.5 | 35.0 | 1.6 | 41.0 | 21.7 | 0.7 |
| 2.5 | 33.5 | 3.3 | 39.8 | 23.1 | 0.3 |
| 3.5 | 32.4 | 3.2 | 39.0 | 24.9 | 0.4 |
| 4.5 | 31.2 | 4.7 | 37.3 | 26.6 | 0.2 |
| 5.5 | 31.9 | 4.9 | 38.4 | 24.6 | 0.2 |

TABLE II

| | Oxidic dust, % w | | |
|---|---|---|---|
| Time, h | CaO | $SiO_2$ | $Al_2O_3$ |
| 0.5 | 0.5 | 0.1 | 0.2 |
| 2.5 | 0.7 | 0.3 | 0.4 |
| 3.5 | 0.4 | 0.1 | 0.1 |
| 4.5 | 0.3 | 0.1 | 0.1 |
| 5.5 | 0.3 | 0.1 | 0.1 |

EXAMPLE II

A magnesia feedstock comprising 83.9% w MgO, 6.7% w $Al_2O_3$, 4.8% w CaO, 2.8% w $SiO_2$, 1.11% w $Fe_2O_3$ and 0.7% w trace impurities was briquetted with a stoichiometric amount of needle coke carbon. A slag composition was prepared by mixing 31.4% w CaO, 5.2% w $SiO_2$, 37.9% w $Al_2O_3$, 25% w MgO and 0.5% w $Fe_2O_3$.

49.7 kg of this mixture was introduced into the reactor described in example 1, melted and heated to a temperature of 2190°K. In 6 hours 21.9 kg feedstock briquettes were added at a constant rate. All processing was carried out as described in Example 1.

The analytical results are represented in Tables III and IV.

The average percentages of CaO, $Al_2O_3$ and $SiO_2$ trapped in the slag are in this example about 92%, 91% and 82%, respectively.

TABLE III

| | Slag composition, % w | | | | | Oxidic dust, % w | | |
|---|---|---|---|---|---|---|---|---|
| Time, h | CaO | $SiO_2$ | $Al_2O_3$ | MgO | FeO | CaO | $SiO_2$ | $Al_2O_3$ |
| 0.5 | 31.2 | 5.4 | 38.0 | 25.2 | 0.2 | 0.8 | 0.8 | 0.8 |
| 2.5 | 29.7 | 5.8 | 36.6 | 28.0 | 0.4 | 0.4 | 0.6 | 0.9 |
| 3.5 | 31.3 | 6.8 | 38.4 | 25.4 | 0.1 | 0.2 | 0.4 | 0.5 |
| 4.5 | 30.9 | 6.5 | 38.3 | 24.3 | 0.4 | 0.4 | 0.3 | 0.3 |
| 5.5 | 30.5 | 6.1 | 38.2 | 24.1 | 0.3 | 0.2 | 0.4 | 0.4 |

We claim:

1. A process for producing magnesium by stoichiometric conversion of magnesia with carbon at a temperature of from 2000° K. to 2300° K. and atmospheric pressure which comprises effecting the reaction in a reactor in the presence of a liquid slag comprising oxides or mixed oxides and carbides of magnesium, calcium and aluminium in relative weight proportions, calculated as atomic metal:metal ratios, which by continued introduction of appropriate feedstock into the reactor are being kept within the following ranges (i) Mg:Ca from 0.28:1 to 1.34:1

(ii) Al:Mg from 0.79:1 to 3.16:1

(iii) Ca:Al from 0.48:1 to 1.50:1 under the proviso that the total amount of gramatom aluminium is less than 51% of the total amount of gramatoms aluminium, calcium and magnesium contained in the slag.

2. A process as claimed in claim 1, in which the atomic metal: metal ratios are being kept within the following ranges (iv) Mg:Ca from 0.46:1 to 1.14:1

(v) Al:Mg from 1.19:1 to 2.43:1

(vi) Ca:Al from 0.56:1 to 1.11:1

3. A process as claimed in claim 1 or 2, in which the reaction is started by reacting carbon with a slag comprising magnesia, calcium-oxide and alumina in relative proportions, calculated as weight:weight ratios, within the ranges (a) MgO:CaO from 0.20:1 to 0.96:1

(b) $Al_2O_3$:MgO from 1.0:1 to 4.0:1

(c) CaO:$Al_2O_3$ from 0.54:1 to 1.67:1, excluding those proportions resulting in slag compositions lying in the area above the line marked 52–57 in FIG. 2.

4. A process as claimed in claim 3, in which the relative proportions are (d) MgO:CaO from 0.33:1 to 0.82:1

(e) $Al_2O_3$:MgO from 1.5:1 to 3.1:1

(f) CaO:$Al_2O_3$ from 0.61:1 to 1.22:1

5. A process for as claimed in claim 1, 2 or 4 in which the reaction is carried out in an arc furnace.

6. A process as claimed in claim 3 in which the reaction is carried out in an arc furnace.

7. A process as claimed in claim 1, 2 or 4 in which the reaction is carried out in a reactor provided with a lining of magnesia refractory bricks.

8. A process as claimed in claim 3 in which the reaction is carried out in a reactor provided with a lining of magnesia refractory bricks.

9. A process as claimed in claim 5 in which the reactor is provided with a lining of magnesia refractory bricks.

10. A process as claimed in claim 6 in which the reactor is provided with a lining of magnesia refractory bricks.

11. A process as claimed in claim 1, 2 or 4 in which the temperature is less than 2250°K.

12. A process as claimed in claim 3 in which the temperature is less than 2250°K.

13. A process as claimed claim 5 in which the temperature is less than 2250°K.

14. A process as claimed in claim 7 in which the temperature is less than 2250°K.

15. A process as claimed in claim 6, 8, 9 or 10 in which the temperature is less than 2250°K.

* * * * *